US006856227B2

(12) United States Patent
Ushio et al.

(10) Patent No.: US 6,856,227 B2
(45) Date of Patent: Feb. 15, 2005

(54) TRANSFORMER FOR IGNITER

(75) Inventors: Hiroki Ushio, Tokyo (JP); Masaru Kibi, Osaka (JP); Mutsuo Sekiya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 268 days.

(21) Appl. No.: 10/110,693

(22) PCT Filed: Aug. 17, 2001

(86) PCT No.: PCT/JP01/07099

§ 371 (c)(1),
(2), (4) Date: Apr. 17, 2002

(87) PCT Pub. No.: WO02/17335

PCT Pub. Date: Feb. 28, 2002

(65) Prior Publication Data

US 2002/0153986 A1 Oct. 24, 2002

(30) Foreign Application Priority Data

Aug. 18, 2000 (JP) ..... 2000-248162

(51) Int. Cl.[7] ..... H01F 27/30
(52) U.S. Cl. ..... 336/198; 336/192
(58) Field of Search ..... 336/65, 83, 192, 336/198, 200, 206–208

(56) References Cited

U.S. PATENT DOCUMENTS 4,904,975 A * 2/1990 Medenbach ..... 336/192
6,078,240 A * 6/2000 Huang ..... 336/90

FOREIGN PATENT DOCUMENTS

| | | |
|---|---|---|
| JP | 3-136938 | 6/1991 |
| JP | 05-198446 | 8/1993 |
| JP | 08-107026 | 4/1996 |
| JP | 09-312225 | 12/1997 |

* cited by examiner

*Primary Examiner*—Tuyen T. Nguyen
(74) *Attorney, Agent, or Firm*—Sughrue Mion, PLLC

(57) ABSTRACT

A transformer for an igniter, in which a primary coil and a secondary coil are wound around a bobbin, is composed of a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers, and a plurality of cut-out portions functioning as a coil taking-in portion and a plurality of coil delivery portions of the disk-shaped partition walls. Therefore, the stabilization of a winding operation is obtained, the loss of coils due to the bending of the coils can be prevented, films of coils can be protected, a small-sized transformer for an igniter can be obtained, and an automatic winding operation can be performed.

10 Claims, 15 Drawing Sheets

TRANSFORMER FOR IGNITER

TECHNICAL FIELD

The present invention relates to a transformer for an igniter which is used for an electric-discharge lamp used as a head lamp of a vehicle such as an automobile and in which a high voltage pulse is generated.

BACKGROUND ART

High intensity discharge lamps such as a metal halide lamp, a high pressure sodium lamp and a mercury lamp selected from various types of electric-discharge lamps respectively have various merits such as a large quantity of light, a high luminous efficiency and a long lamp life. Therefore, in a prior art, each high intensity discharge lamp is used as an illuminating lamp or a street lamp disposed in indoor and outdoor facilities, a warehouse or a factory. To light this type of high intensity discharge lamp, it is required to apply a starting high voltage to the high intensity discharge lamp in a starting operation. Therefore, in addition to a ballast used to stably light the high intensity discharge lamp, an igniter is attached to the high intensity discharge lamp so as to generate a starting high voltage.

FIG. 1 is a vertical sectional view of a conventional high intensity discharge head lamp for automobile in a vehicle side direction and is disclosed in Published Unexamined Japanese Patent Application H3-136938 (1991).

A reflector 2 having a function of a reflecting mirror is disposed in a housing 1 to converge and control a light beam, and an inner surface of the reflector 2 is coated to form a reflecting surface. A high intensity discharge bulb 4 held by a valve socket 3 is disposed in the almost center of the reflector 2. To light the high intensity discharge bulb 4, an igniter 5 generating a high voltage of 30 KV is disposed in a high intensity discharge lamp equipment. Here, a lighting control of a high intensity discharge lighting device is performed in a power supply control circuit (or a ballast) 7. In the above-described configuration of the high intensity discharge lighting device, a high voltage is applied to the high intensity discharge bulb 4 in a moment to induce a high voltage discharge of the high intensity discharge bulb 4, the discharge of gas packed in the high intensity discharge bulb 4 occurs, and the high intensity discharge bulb 4 is lighted. 8 indicates a lens. A beam of light of the high intensity discharge bulb 4 is dispersed in a prescribed area through the lens 8 and is radiated in a front direction of a vehicle. Therefore, the safety of the vehicle is secured during the running of the vehicle in the dark.

As is described above, a high intensity discharge lamp is disposed in a space between a bumper 9 and an engine hood 10. 11 indicates a harness electrically connecting the high intensity discharge lamp equipment and the ballast 7.

Also, 12 indicates a substrate on which the high intensity discharge bulb 4 is fitted. 13 indicates a transformer in which a primary coil and a secondary coil are wound, and a starting voltage of the high intensity discharge bulb 4 is generated in the transformer 13. 14 indicates a condenser for charging a starting energy. 15 indicates a discharge gap element. An electric potential difference occurs between both ends of the discharge gap element 15 when the discharge gap element 15 is charged by the condenser 14, the discharge of gas sealed in the discharge gap element 15 is started in a moment due to the dielectric breakdown of the gas, and current is carried to the primary coil of the transformer 13. Therefore, a high voltage pulse of a voltage ranging from 20 KV to 30 KV is generated in the secondary coil of the transformer 13, the electric discharge of the high intensity discharge bulb 4 is induced, and the lightening of the high intensity discharge bulb 4 is generated. 16 indicates a cap. Here, the igniter 5 is a general name of a starting device composed of the substrate 12, the transformer 13, the condenser 14 and the discharge gap element 15.

In the prior art described above, it is troublesome to wind the primary and secondary coils around a bobbin of the transformer 13. Therefore, the transformer 13 is not appropriate for the stabilization of a coil winding operation, the prevention of the broken coil, the protection of films coated on the primary and secondary coils, the production of a small-sized transformer and an automatic wiring operation.

The present invention is provided to solve the above-described problem, and the object of the present invention is to provide a transformer in which a shape of a bobbin is determined to perform an automatic coil wiring operation and which has a high reliability.

DISCLOSURE OF THE INVENTION

A transformer for an igniter according to the present invention, in which a primary coil and a secondary coil are wound around a bobbin, comprises a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers, and a plurality of cut-out portions functioning as a coil taking-in portion and a plurality of coil delivery portions of the disk-shaped partition walls.

Therefore, because one cut-out portion functioning as the coil taking-in portion is disposed, the secondary coil can be always taken in the coil winding grooves at a fixed position. Also, because the other cut-out portions functioning as the coil delivery portions are disposed, the secondary coil can be always delivered from one coil winding groove to another coil winding groove successively at a fixed position. Accordingly, the damage of the secondary coil due to an acute bending of the secondary coil in each coil delivery portion can be prevented. Also, because the secondary coil can be delivered from one coil winding groove to another coil winding groove at a fixed position, the displacement of the secondary coil can be prevented. Therefore, the automatic winding of the secondary coil can be easily performed, and a transformer for an igniter having a high reliability can be obtained.

The cut-out portions functioning as the coil taking-in portion and the coil delivery portions of the disk-shaped partition walls reach a plurality of bottom surfaces of the coil winding grooves of the bobbin respectively by cutting out the disk-shaped partition walls to depths of the bottom surfaces of the coil winding grooves.

Because the cut-out portions are deeply cut out so as to reach the bottom surfaces of the coil winding grooves of the bobbin respectively, when the winding of the secondary coil in a next coil winding groove is started after the secondary coil is wound around the bobbin in one coil winding groove, the bending of the secondary coil in the partition walls can be minimized due to the cut-out portions cut out to the bottom surfaces of the coil winding grooves. Also, the winding of the secondary coil can be started from the most-end side of the next coil winding groove. Accordingly, a transformer for an igniter having no displacement of the secondary coil can be easily manufactured on condition that the number of turns of the secondary coil is always stabilized, and a transformer for an igniter having a high reliability can be obtained.

Also, the cut-out portions functioning as the coil taking-in portion and the coil delivery portions of the disk-shaped partition walls are obtained by cutting out the disk-shaped partition walls in an almost tangent direction to the bottom surfaces of the coil winding grooves of the bobbin.

Because the cut-out portions are cut out in the almost tangent direction to the coil winding grooves of the bobbin, when the winding of the secondary coil in a next coil winding groove is started after the secondary coil is wound around the bobbin in one coil winding groove, the bending of the secondary coil in the partition walls can be further minimized due to the winding start position directed in the almost tangent direction to the coil winding grooves. Also, the winding of the secondary coil can be started from the most-end side of the next coil winding groove. Accordingly, a transformer for an igniter having no displacement of the secondary coil can be easily manufactured on condition that the number of turns of the secondary coil is always stabilized, and a transformer for an igniter having a high reliability can be obtained.

Also, each of the cut-out portions functioning as the coil taking-in portion and the coil delivery portions of the disk-shaped partition walls does not reach the bottom surface of the corresponding coil winding groove of the bobbin, and each cut-out portion and the bottom surface of the corresponding coil winding groove are connected with each other by a coil escape groove becoming hollow on one side surface of the corresponding partition wall in a thickness direction of the corresponding partition wall.

When the winding of the secondary coil in a next coil winding groove is started after the secondary coil is wound around the bobbin in one coil winding groove, the secondary coil of the coil delivery portions is pushed into the coil escape grooves. Therefore, the secondary coil can be uniformly wound in the whole coil winding grooves without receiving the adverse influence of the secondary coil of the coil delivery portions. Accordingly, a transformer for an igniter having no displacement of the secondary coil can be easily manufactured on condition that the number of turns of the secondary coil is always stabilized, and a transformer for an igniter having a high reliability can be obtained.

Also, each cut-out portion and the corresponding coil escape groove disposed on one side surface of the corresponding partition wall are connected with each other on an almost straight line, and the straight line is directed in an almost tangent direction to the bottom surface of the corresponding coil winding groove of the bobbin.

Each coil escape groove is connected to the corresponding cut-out portion on an almost straight line, and each straight line can be directed in an almost tangent direction to the bottom surface of the corresponding coil winding groove. Therefore, because the secondary coil of the coil delivery portions can be further easily pushed into the coil escape grooves, the secondary coil can be uniformly wound in the whole coil a winding grooves without receiving the adverse influence of the secondary coil of the coil delivery portions. Accordingly, a transformer for an igniter having no displacement of the secondary coil can be easily manufactured on condition that the number of turns of the secondary coil is always stabilized, and a transformer for an igniter having a high reliability can be obtained.

Also, the cut-out portions functioning as the coil taking-in portion and the coil delivery portions of the disk-shaped partition walls are respectively formed in a taper shape to widen outward and to gradually narrow inward.

Therefore, because the secondary coil can be reliably lead to the cut-out portions, the stable delivery of the secondary coil can be always performed.

Also, the coil taking-in portion is formed by cutting out the corresponding partition wall to take a winding start end of the secondary coil connected to a high voltage terminal in the corresponding coil winding groove, and a rib-shaped edge portion projected in an axial direction of the corresponding partition wall is disposed on either a whole circumferential edge of the coil taking-in portion or at least a part of the circumferential edge of the coil taking-in portion making contact with the secondary coil.

When the secondary coil is taken in the coil winding groove, the strength of the edge portion of the cut-out portion can be heightened. Accordingly, it can be prevented that the cut-out portion is damaged due to a tensile force of the secondary coil.

Whole circumferential edge portions of the cut-out portions functioning as the coil taking-in portion and the coil delivery portions of the disk-shaped partition walls or at least corner portions of circumferential edge portions of the cut-out portions making contact with the secondary coil are respectively formed in a curved shape or are respectively chamfered.

Therefore, there is no probability that a film coated on the secondary coil making contact with the corner portion is damaged. Accordingly, drawbacks such as a rare short due to the destruction of the film of the secondary coil can be prevented.

A transformer for an igniter, in which a primary coil and a secondary coil are wound around a bobbin, comprises a plurality of partition walls disposed on the bobbin so as to form a plurality of coil winding grooves corresponding to the secondary coil ranging from a low voltage step to a high voltage step in layers, and a plurality of resin leading grooves disposed on a plurality of side surfaces of the partition walls to harden a lamination layer portion of the primary and secondary coils with resin after the winding of the primary and secondary coils.

Therefore, even though the density of the coils is high, there is no probability that the resin leading grooves are covered with the primary and secondary coils. Accordingly, the resin injected from the resin leading grooves can easily permeate the inside of the lamination layer portion of the primary and secondary coils, and the reliability of the lamination layer portion of the primary and secondary coils can be considerably improved.

The resin leading grooves reach bottom surfaces of the coil winding grooves, and a line directed in an extension direction of each resin leading groove does not intersect an axial line of the bobbin.

Therefore, each resin leading groove can be lengthened. Accordingly, because the resin can further uniformly permeate the lamination layer or portion of the primary and secondary coils, the reliability of the lamination layer portion of the primary and secondary coils can be considerably improved.

A transformer for an igniter, in which a primary coil and a secondary coil are wound around a bobbin and resin is injected into a peripheral space of the bobbin, comprises a plurality of partition walls disposed on the bobbin so as to form a plurality of coil winding grooves corresponding to the secondary coil ranging from a low voltage step to a high voltage step in layers, wherein a diameter of a most-outer circumference of a part of each partition wall is changed in a circumferential direction of the partition wall.

Therefore, in cases where the bobbin is disposed in a bobbin case, though a portion of each partition wall corresponding to a larger most-outer circumferential diameter of the partition walls makes contact with an inner wall of the bobbin case, a prescribed space can be formed between another portion of each partition wall corresponding to a smaller most-outer circumferential diameter of the partition walls and the inner wall of the bobbin case. Accordingly, because the portions of the partition walls corresponding to the larger most-outer circumferential diameter of the partition walls make contact with the bobbin case, the displacement of the bobbin in the radial direction of the bobbin can be suppressed. Also, the resin is packed in the outer circumferential space of the bobbin to improve the electric insulation, the water proof and the vibration proof of the bobbin inserted into the bobbin case and fixed. In this case, because the most-outer circumferential diameter of portions of the partition walls is set small, a space between the group of the partition walls and the bobbin case functions as a resin leading path, and the whole outer circumferential portion of the bobbin can be uniformly protected.

A transformer for an igniter, in which a primary coil and a secondary coil are wound around a bobbin, comprises a pair of twining protrusive portions, which are protruded from either a most-outer circumferential wall of a low voltage side end portion of the bobbin or an arbitrary point near to the most-outer circumferential wall of the low voltage side end portion of the bobbin in both tangent directions to the most-outer circumferential wall of the low voltage side end portion of the bobbin respectively to twine a winding finish end of the secondary coil, which is wound in a plurality of layers of coil winding grooves, and both a winding start end and a winding finish end of the primary coil, which is wound around an outer circumferential portion of the secondary coil, around the twining protrusive portions, and a total length of the twining protrusive portions is set to be equal to or lower than the diameter of the most-outer circumferential wall of the low voltage side end portion.

Therefore, the length of the coil twining portions can be lengthened at its maximum without enlarging the bobbin case. Accordingly, a small-sized device and a coil twining operation with facility can be obtained.

A transformer for an igniter, in which a primary coil and a secondary coil are wound around a bobbin, comprises a pair of positioning protrusive portions, each of which is disposed on at least one of a pair of partition walls surrounding a coil winding groove, in which either a winding start end or a winding finish end of the primary coil is placed, to twine both the winding start end and the winding finish end of the primary coil around the positioning protrusive portions.

Therefore, the disorder of the primary coil wound can be prevented, and the winding positions of both the winding start end and the winding finish end of the primary coil can be reliably fixed. Accordingly, the automatic manufacturing can be easily performed so as to stably perform the winding operation of the primary coil wound on the outside of the secondary coil.

A transformer for an igniter, which is used for a vehicle head lamp control device comprising a high intensity discharge bulb disposed in a head lamp of an automobile, a ballast for supplying an alternating current power from a battery power source to the high intensity discharge bulb, an igniter for generating a high voltage pulse to start the discharge of the high intensity discharge bulb and a high voltage terminal for supplying a high voltage to the high intensity discharge bulb and in which the high voltage terminal penetrates through a central area of a bobbin and both a primary coil and a secondary coil are wound around the bobbin which has a plurality of coil winding grooves formed in layers, comprises a secondary coil taking-in slit which is disposed in a direction perpendicular to a bending direction of a top end of the high voltage terminal around which the secondary coil is twined.

Because a positional relationship between the secondary coil taking-in slit and the top end of the high voltage terminal is set not to excessively loosen or tighten the winding start end of the secondary coil on condition that the top end of the high voltage terminal is bent after the winding of the secondary coil, drawbacks such as the loss and loosening of the secondary coil due to the bending of the secondary coil at the high voltage terminal can be prevented, and a small-sized transformer can be obtained in the automatic winding operation with high reliability.

A transformer for an igniter, which is used for a vehicle head lamp control device comprising a high intensity discharge bulb disposed in a head lamp of an automobile, a ballast for supplying an alternating current power from a battery power source to the high intensity discharge bulb, an igniter for generating a high voltage pulse to start the discharge of the high intensity discharge bulb and a bulb socket for holding the high intensity discharge bulb, comprises a plurality of contact elements of a high voltage terminal divided each other, and a plurality of contact elements of a low voltage terminal divided each other. One pair of contact elements of the high voltage terminal, which is disposed to place a high voltage plug of the high intensity discharge bulb between the pair of contact elements of the high voltage terminal, and one pair of contact elements of the low voltage terminal apart from each other in a circumferential direction so as to make contact with a low voltage plug of the high intensity discharge bulb are disposed so as to make an extension line of a symmetric axis of the pair of contact elements of the high voltage terminal almost intersect a connection line connecting the pair of contact elements of the low voltage terminal at right angles at an almost central point of the connection line.

The pair of contact elements of the high voltage terminal and the pair of contact elements of the low voltage terminal are disposed so as to make the connection line connecting the pair of contact elements of the low voltage terminal be perpendicular to the extension line of the symmetric axis of the pair of contact elements of the high voltage terminal, and the pair of contact elements of the low voltage terminal are disposed on both sides of the symmetry line at almost 45 degrees respectively with respect to the symmetry line. Accordingly, in cases where the plugs of the high intensity discharge bulb are held by all the contact elements of the high and low voltage terminals, the holding force of the contact elements of the high voltage terminal and the holding force of the contact elements of the low voltage terminal are not shifted in the same direction as each other or the perpendicular direction to each other, and the high intensity discharge bulb can be further stably held.

BEST MODE FOR CARRYING OUT THE INVENTION

Hereinafter, the best mode for carrying out the present invention will now be described with reference to the accompanying drawings to explain the present invention in more detail.

Embodiment 1

Figure 1:
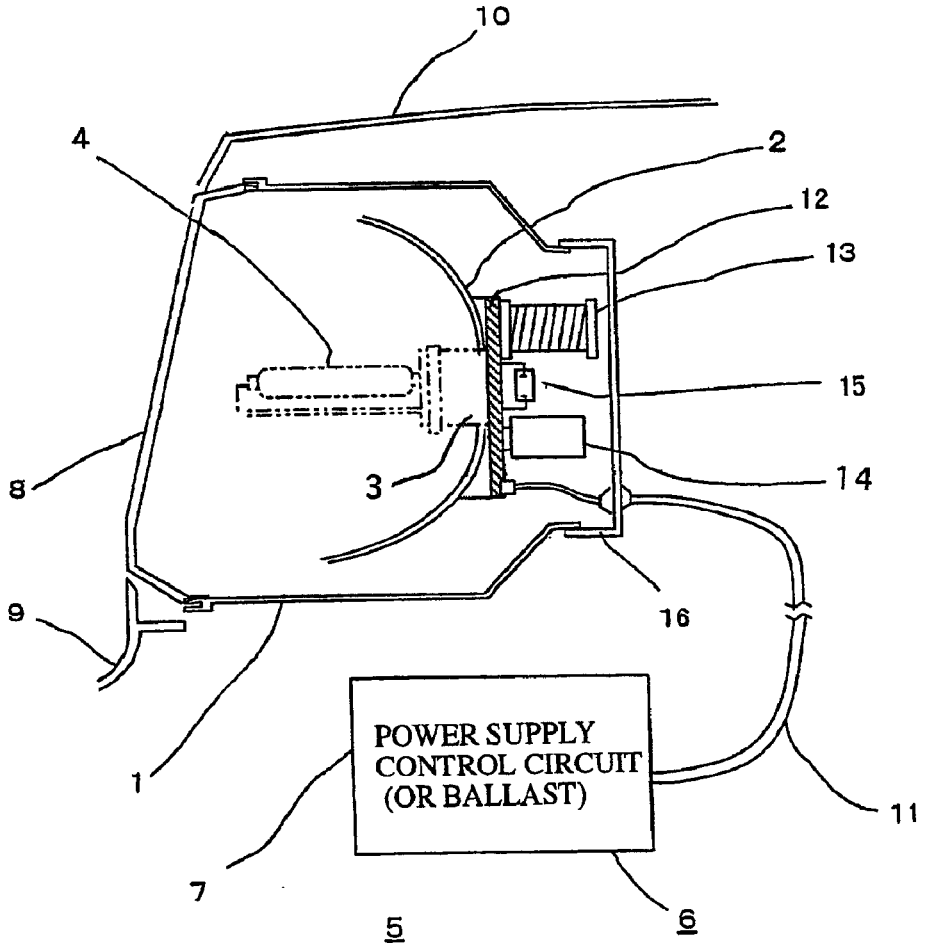
FIG. 1 is a view of a conventional high intensity discharge lighting device.
Figure 2:
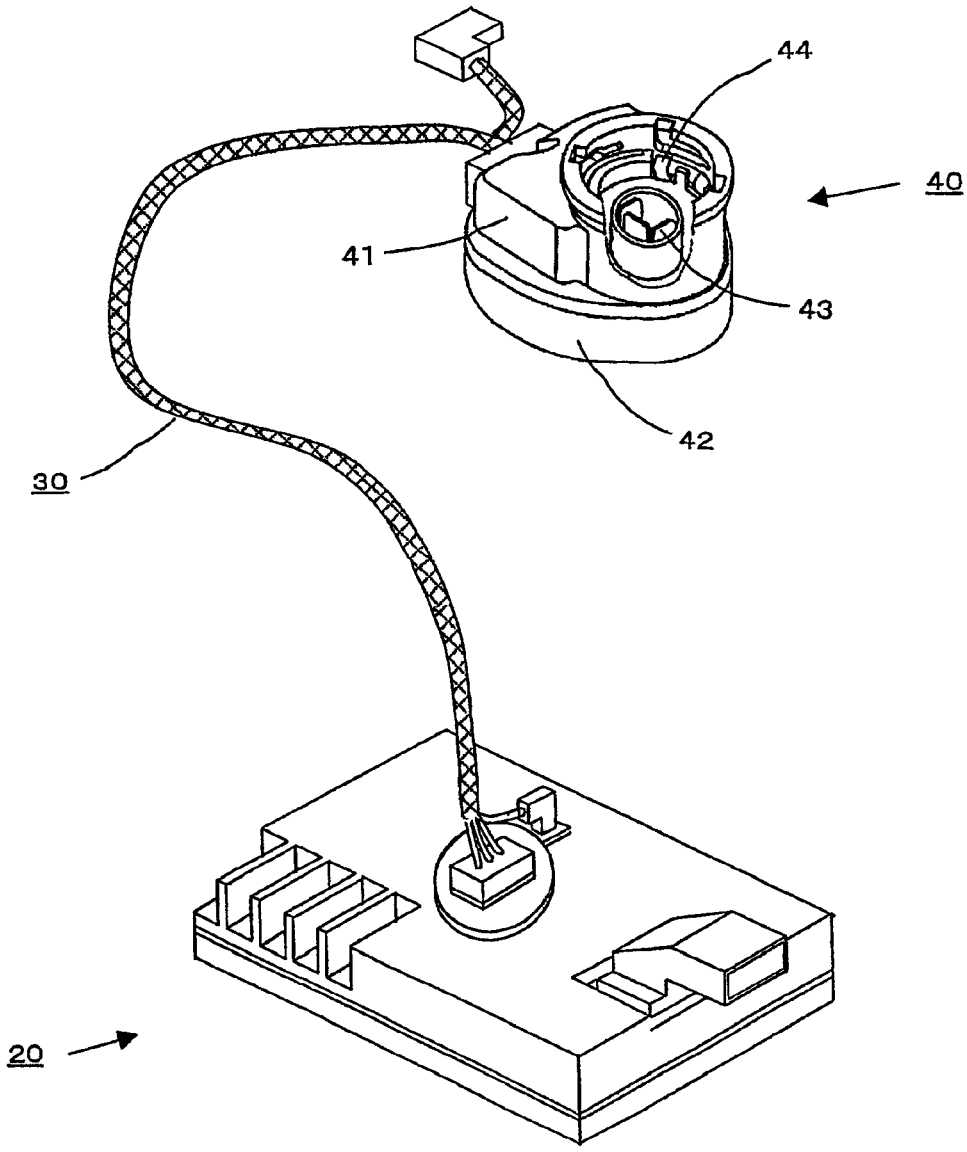
FIG. 2 is a main constitutional view of a high intensity discharge lighting device.
Figure 3:
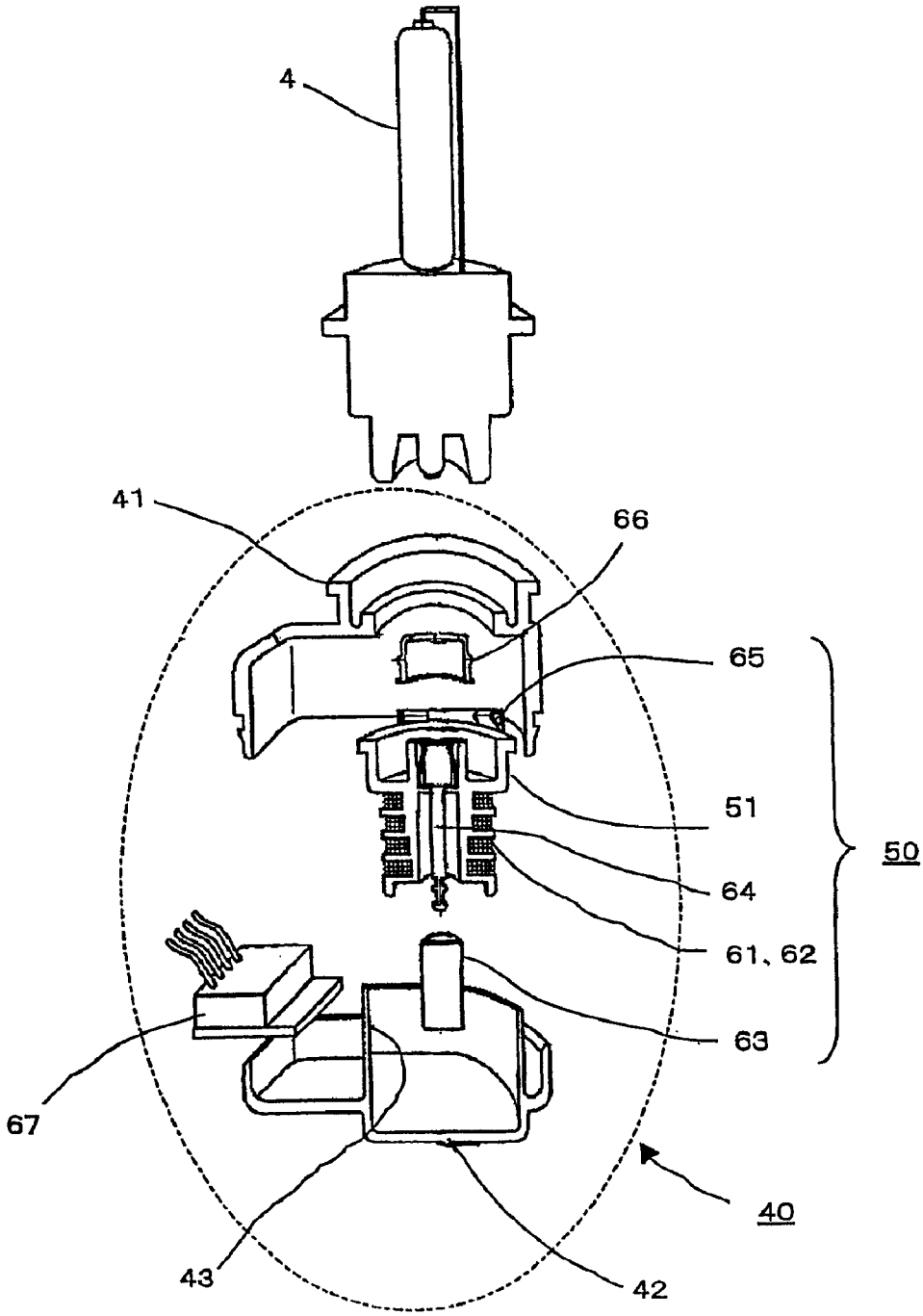
FIG. 3 is a cross sectional view of a bulb socket integrally formed with an igniter for the high intensity discharge lighting device.

FIG. 2 is an explanation view of main elements of a high intensity discharge lighting device having a bulb socket integrally formed with an igniter, and FIG. 3 is a cross sectional diagonal view of the bulb socket integrally formed with the igniter.

In FIG. 2 and FIG. 3, 20 indicates a ballast body in which a power supply circuit and a control circuit are disposed. 30 indicates a harness. 40 indicates an igniter-integrated bulb socket in which a bulb socket is integrally formed with an igniter. A driving power sent from the ballast 20 through the harness 30 is received in the igniter-integrated bulb socket 40, and a lighting control for a high intensity discharge bulb 4 is performed in the igniter.

Also, 50 indicates a transformer, and 51 indicates a bobbin formed of resin.

Next, the configuration of the igniter-integrated bulb socket 40 shown in FIG. 3 will be described.

40 indicates the igniter-integrated bulb socket in which a starting circuit for performing a lighting control of the high intensity discharge bulb 4 is integrally disposed. A driving power sent from the ballast 20 through the harness 30 is received in the bulb socket 40, and a lighting control for a high intensity discharge bulb 4 is performed in the igniter. 41 indicates an upper case of the igniter-integrated bulb socket 40. 42 indicates a lower case of the igniter-integrated bulb socket 40. 43 indicates a bobbin case in which the transformer 50 described later is disposed. 50 indicates the transformer. The transformer 50 comprises the bobbin 51, a secondary coil 62 wound around the bobbin 51, a primary coil 61 wound around the bobbin 51 on the outside of the secondary coil 62, a high voltage terminal 64 inserted into a central portion of the bobbin 51, a core 63 inserted into a central hollow of the bobbin 51 and making contact with the high voltage terminal 64 and a low voltage terminal 65 disposed at an end portion of an outer circumference of the bobbin 51.

Also, an insulating member 66 is disposed between the high voltage terminal 64 and the low voltage terminal 65 to electrically insulate the high voltage terminal 64 and the low voltage terminal 65 from each other. 67 indicates elements of a control circuit including a condenser 14, a discharge gap element 15 and the like.

The transformer 50 having the configuration described above is inserted into the bobbin case 43 disposed in the lower case 42, and resin is injected into a peripheral space of the transformer 50 so as to pack the resin in a space between the transformer 50 and the bobbin case 43. Also, the elements 67 of the electric circuit are disposed in the lower case 42, and the upper case 41 is put on the lower case 42. Therefore, the igniter-integrated bulb socket 40 is obtained. Here 4 indicates the high intensity discharge bulb, and the high intensity discharge bulb 4 is held by the igniter-integrated bulb socket 40.

Figure 4:
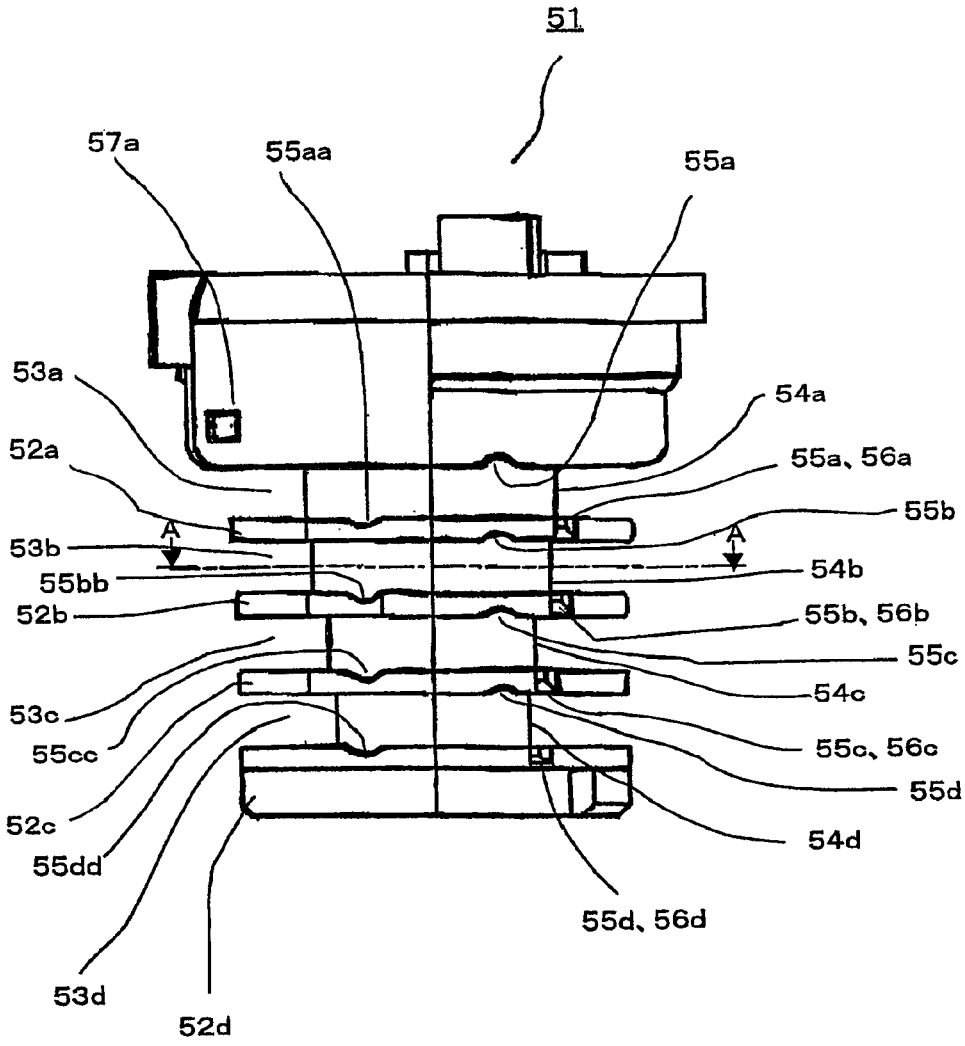
FIG. 4 is a cross sectional view of a bobbin according to a first embodiment of the present invention.

FIG. 4 shows a shape of the bobbin 51 denoting a constitutional element composing the transformer 50.

In FIG. 4, 52 (52*a* to 52*d*) indicate a plurality of partition walls respectively. 53*a* to 53*d* indicate a plurality of coil winding grooves partitioned by the partition walls 52*a* to 52*d*. 54*a* to 54*d* indicate a plurality of bottom surfaces of the coil winding grooves 53*a* to 53*d*. 55 (55*a* to 55*d*) indicate a plurality of cut-out portions obtained by cutting out portions of the partition walls 52*a* to 52*d*. The cut-out portion 55*d* functions as a coil taking-in portion, and the cut-out portions 55*a* to 55*c* function as a plurality of coil delivery portions. 56*a* to 56*d* indicate a plurality of coil escape grooves respectively. Each coil escape groove 56*a*, 56*b*, 56*c* or 56*d* is disposed between the corresponding cut-out portion 55*a*, 55*b*, 55*c* or 55*d* and the corresponding bottom surface 54*a*, 54*b*, 54*c* or 54*d* of the coil winding groove 53*a*, 53*b*, 53*c* or 53*d*. 57*a* indicates a twining protrusive portion around which both a winding start portion and a winding finish portion of the primary coil 61 and both a winding start portion and a winding finish portion of the secondary coil 62 are twined. 58*a* to 58*d* and 58*aa* to 58*dd* indicate a plurality of resin leading grooves respectively. After the coil winding operation is completed, the resin permeates a space formed in a coil winding portion through the resin leading grooves 58*a* to 58*d* and 58*aa* to 58*dd*.

Figure 5:
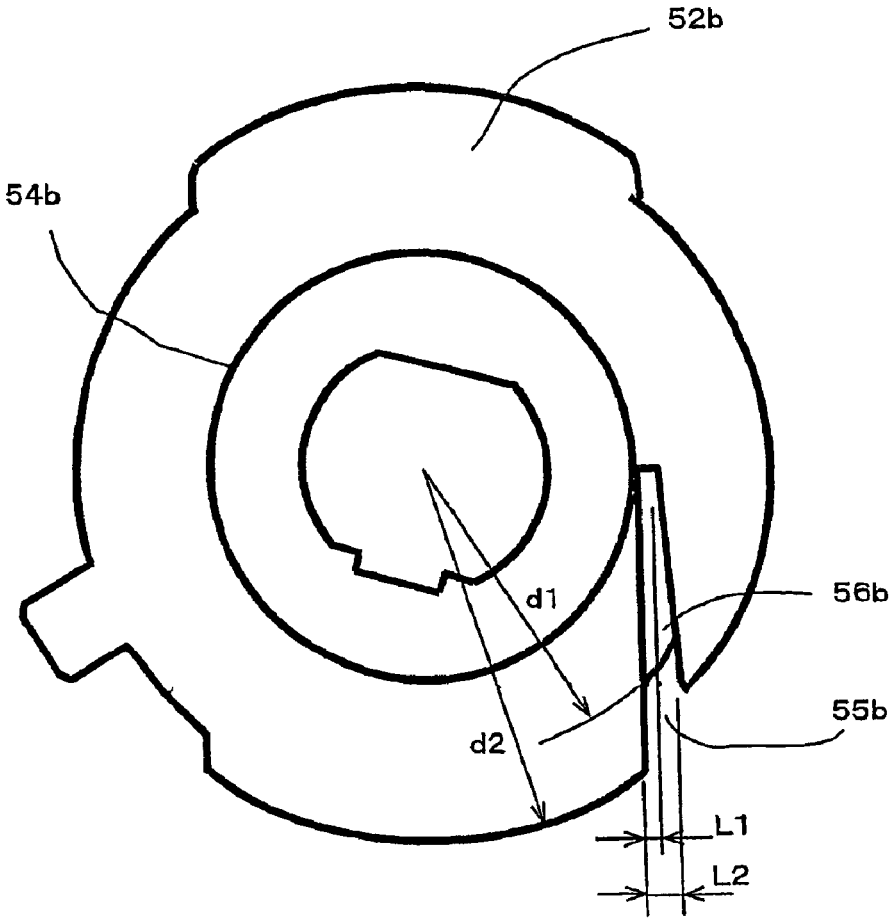
FIG. 5 is a plan view of a partition wall and a diagonal view of the partition wall according to the first embodiment of the present invention.
Figure 5:
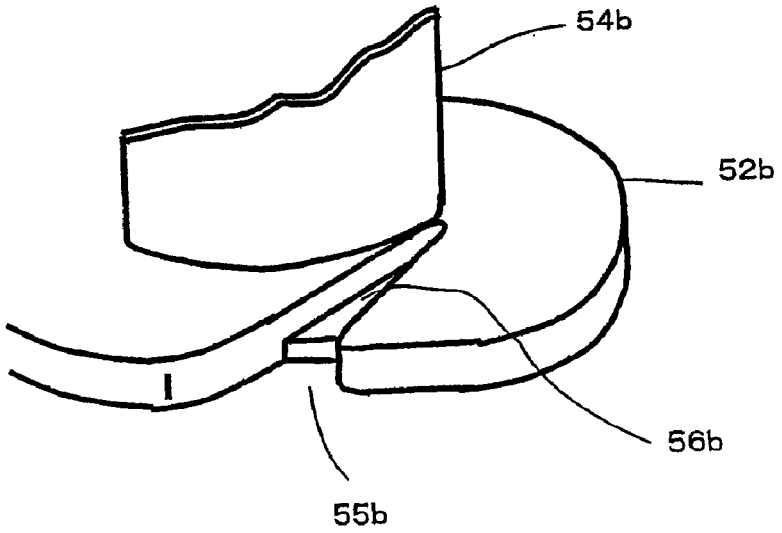

FIG. 5 is a view explaining a shape of the cut-out portion 55*b* and is a sectional view taken substantially along line A—A of FIG. 4.

In FIG. 5, 52*b* indicates the partition wall, 54*b* indicates the bottom surface of the coil winding groove 53*b*, 55*b* indicates the cut-out portion, and 56*b* indicates the coil escape groove. The cut-out portion 55*b* is formed in a taper shape so as to gradually narrow a width in a direction from the outer circumference to the inner circumference, and the relationship $L1<L2$ is satisfied. Also, the cut-out portion 55*b* leads to the coil escape groove 56*b*, and the bottom surface 54*b* of the coil winding groove 53*b* is not cut out. Therefore, a depth of the cut-out portion 55*b* is equal to a value $d2-d1$.

Figure 6:
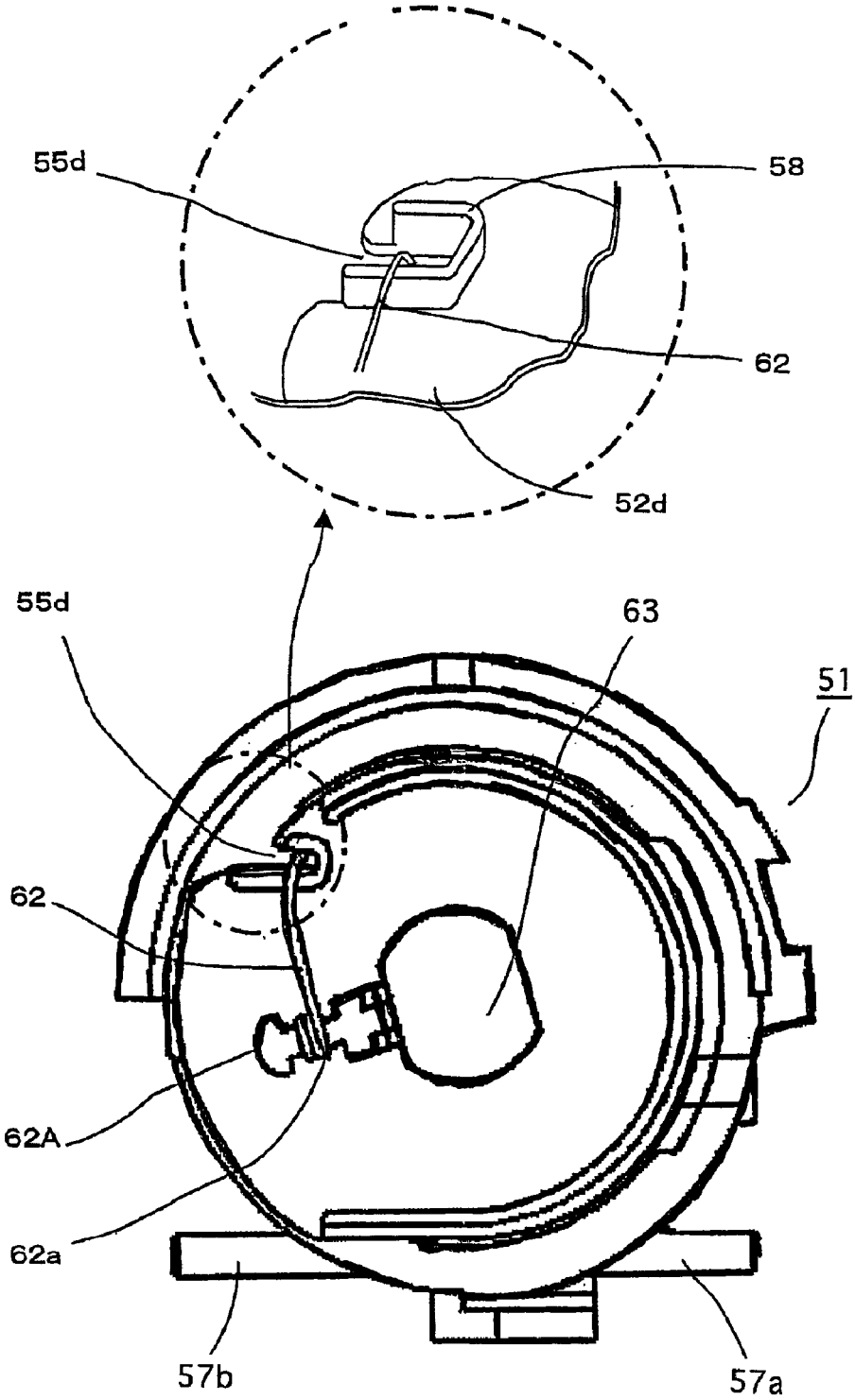
FIG. 6 is a plan view showing a bottom portion of the bobbin according to the first embodiment of the present invention.

As shown in FIG. 6, the cut-out portion 55*d* functioning as a coil taking-in portion is formed to take the secondary coil 62, which is twined around an end portion 64*a* of the high voltage terminal 64, in the coil winding groove 53*d* of the bobbin 51, and an edge portion 58 is formed in an edge area of the cut-out portion 55*d* for the purpose of both the protection of the wound secondary coil 62 and the reinforcement of the cut-out portion 55*d*. Therefore, the secondary coil 62 can be always taken in the coil winding groove 53*d* of the bobbin 51 through a fixed position of the cut-out portion 55*d*. Also, the deformation of a coil taking-in portion and the formation of a crack of the coil taking-in portion can be prevented.

Figure 7:
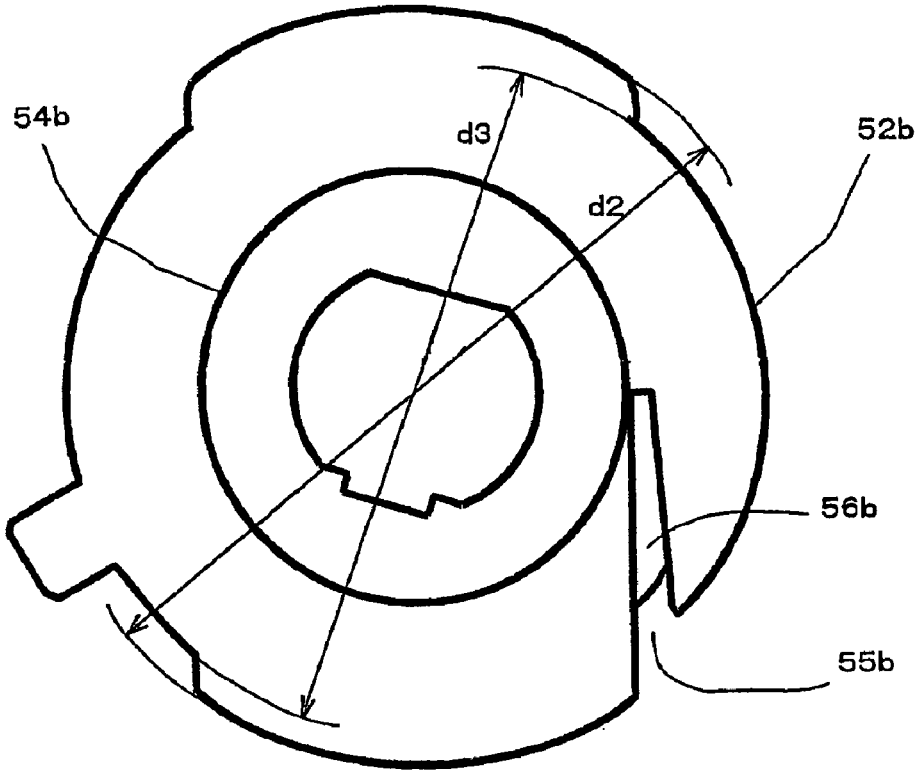
FIG. 7 is a plan view of the partition wall according to the first embodiment of the present invention.

As shown in FIG. 7, an outer circumference diameter of parts of the partition wall 52*b* differs from that of the other parts of the partition wall 52*b*, and the relationship d2>d3 is satisfied. The difference in the outer circumference diameter is applied for all partition walls 52*a* to 52*d*. The outer circumference diameter d2 of the partition walls 52*a* to 52*d* is almost equal to or slightly smaller than an inner diameter of the bobbin case 43 to insert the bobbin 51 into the bobbin case 43. Therefore, a space corresponding to the difference d2−d3 is formed between the bobbin case 43 and the group of the partition walls 52*a* to 52*d* in a condition that the bobbin 51 is disposed in the bobbin case 43, and it is easy to inject the resin into the space between the transformer 50 and the bobbin case 43 through the space between the bobbin case 43 and the group of the partition walls 52*a* to 52*d*.

Figure 8:
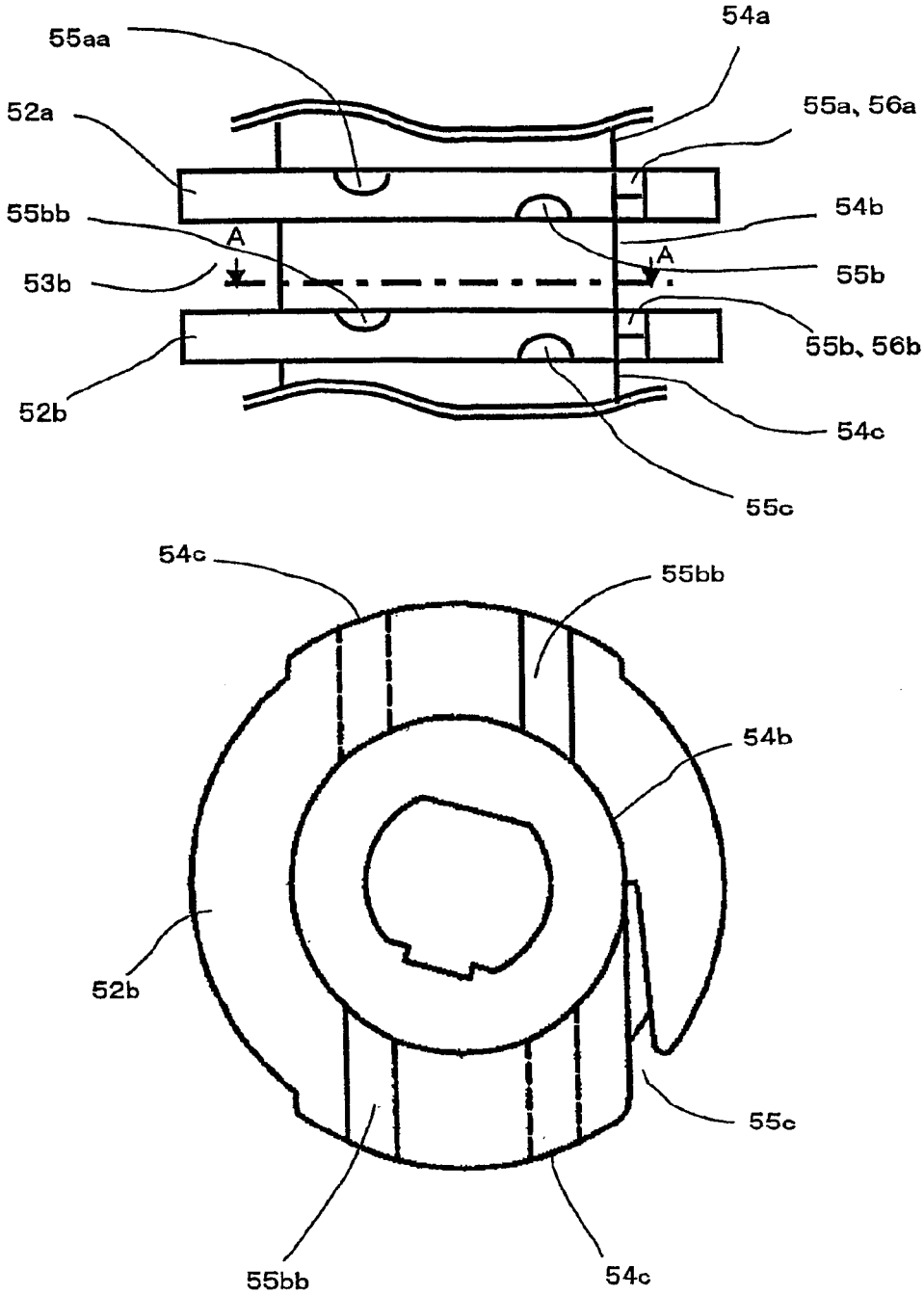
FIG. 8 is a side view of the partition wall and a plan view of the partition wall according to the first embodiment of the present invention.

As shown in FIG. 8, the resin leading grooves 58*aa*, 58*b*, 58*bb* and 58*c* are formed on side surfaces of the partition walls 52*a* and 52*b*. A line directed in an extension direction of each resin leading groove 58*aa*, 58*b*, 58*bb* or 58*c* does not intersect an axial line of the bobbin 51. It is preferred that the resin leading grooves 58*bb* and 58*c* are formed to be extended in a direction tangent to the bottom surface 54*b* of the corresponding coil winding groove 53*b*. In this case, the resin leading grooves 58*bb* and 58*c* can be lengthened, and the permeation of the resin to the space formed around the coils 61 and 62 can be improved.

Figure 9:
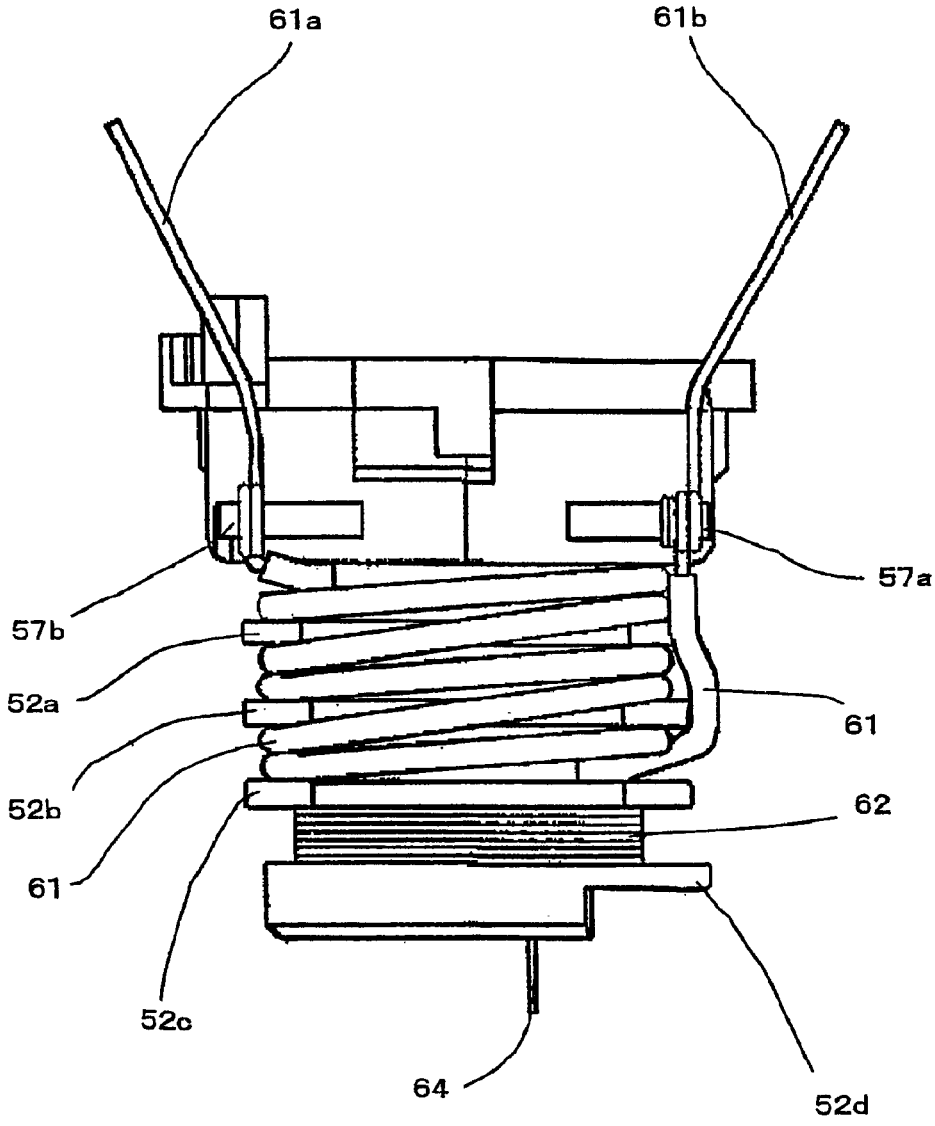
FIG. 9 is a side view of a transformer according to the first embodiment of the present invention.

FIG. 9 shows a pair of twining protrusive portions 57 (57*a* and 57*b*) around which the primary coil 61 wound on the outside of the secondary coil 62 is twined. As shown in FIG. 6, the twining protrusive portions 57 are protruded from the outer circumference portion of the bobbin 51 in both directions tangent to the outer circumference portion of the bobbin 51 respectively. A total length of the twining protrusive portions 57 is equal to or slightly smaller than the outer diameter of the bobbin 51. Therefore, because the twining protrusive portions 57 can sufficiently have protrusive lengths respectively to twine a winding start portion 61*a* and a winding finish portion 61*b* of the primary coil 61 respectively, it is not required to excessively increase the outer diameter of the bobbin 51.

Figure 10:
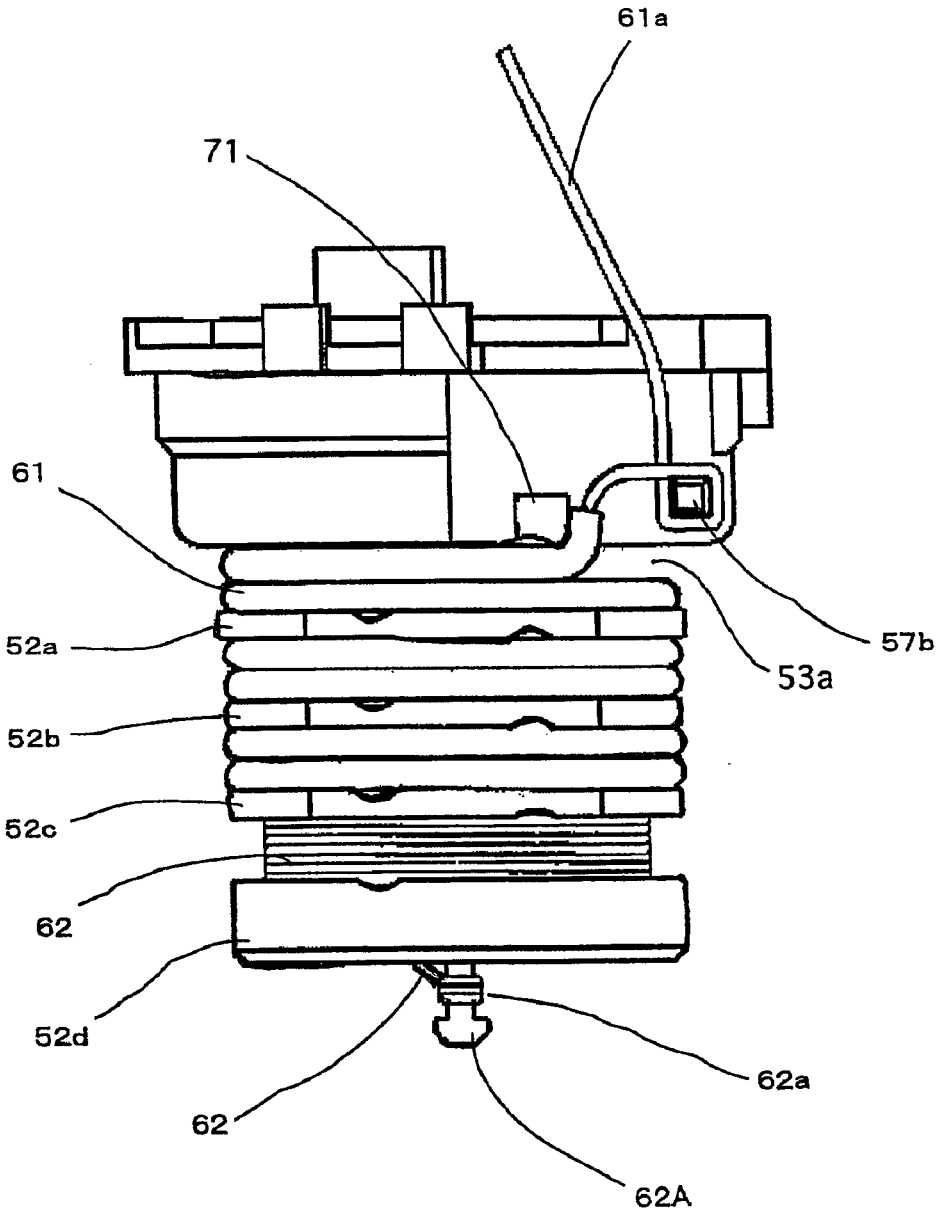
FIG. 10 is another side view of the transformer according to the first embodiment of the present invention.

FIG. 10 is a view explaining the winding start portion 61*a* of the primary coil 61. 71 indicates a positioning protrusive portion. After the winding start portion 61*a* of the primary coil 61 is twined around the twining protrusive portion 57*b*, the winding start portion 61*a* of the primary coil 61 is caught by the positioning protrusive portion 71, and the winding of the primary coil 61 around the bobbin 51 is started. Therefore, an operator can always start on winding the primary coil 61 around the bobbin 51 at a fixed position of the bobbin 51.

Figure 11:
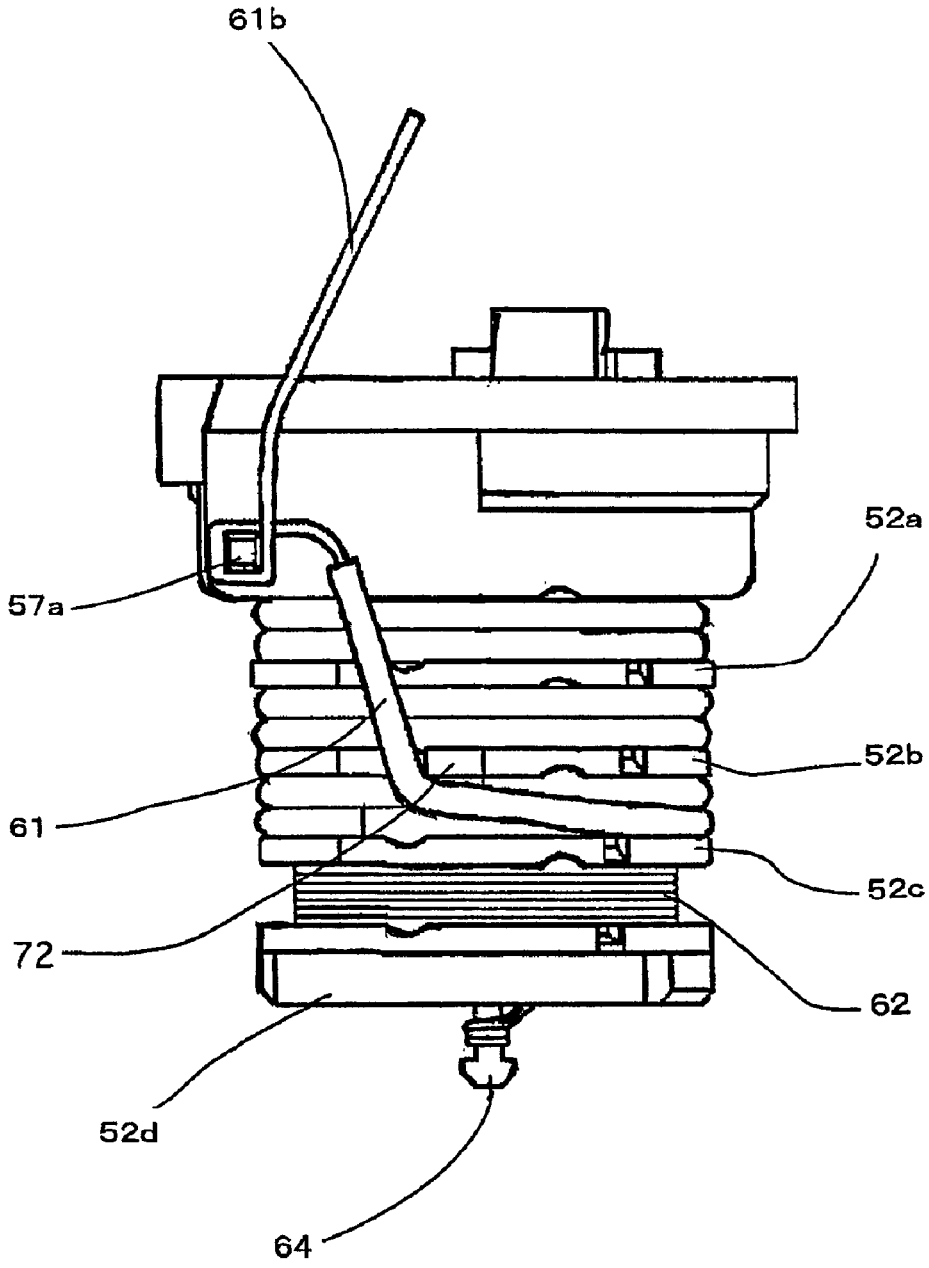
FIG. 11 is another side view of the transformer according to the first embodiment of the present invention.

FIG. 11 is a view explaining the winding finish portion 61*b* of the primary coil 61. 72 indicates a positioning protrusive portion. After the primary coil 61 is wound around the bobbin 51 in the coil winding groove 53*c*, the winding finish portion 61*b* of the primary coil 61 is caught by the positioning protrusive portion 72 to place the primary coil 61 at a fixed position of the bobbin 51, and the winding finish portion 61*b* of the primary coil 61 is twined around the twining protrusive portion 57*a* and is fixed. Therefore, because the winding finish portion 61*b* of the primary coil 61 can be fixed to the bobbin 51, the displacement and loosening of the primary coil 61 can be perfectly prevented.

Figure 12:
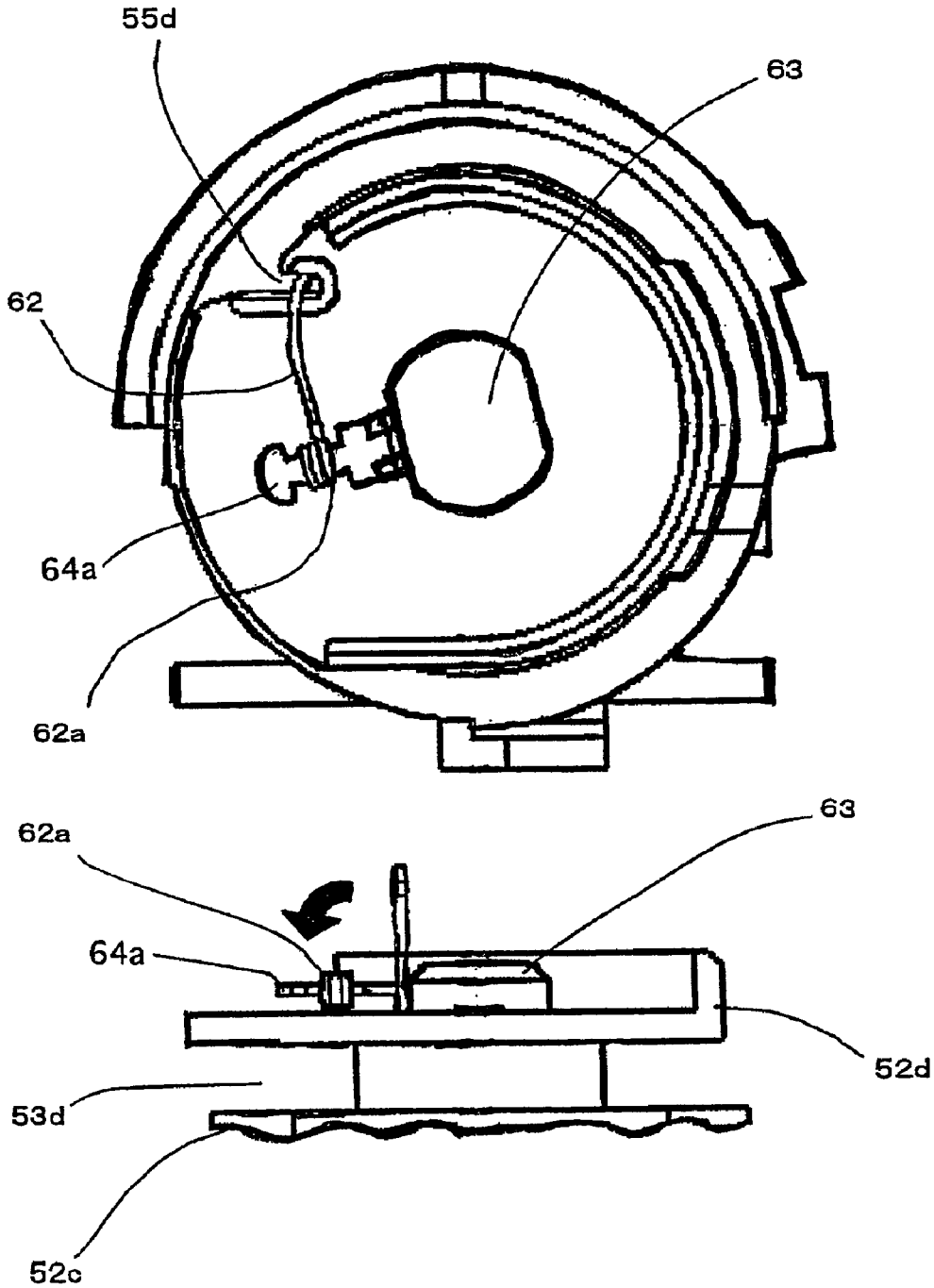
FIG. 12 is another plan view showing the bottom portion of the bobbin according to the first embodiment of the present invention.

FIG. 12 is a view explaining a coil winding operation at the end portion 64*a* of the high voltage terminal 64. After the secondary coil 62 is wound around the end portion 64*a* of the high voltage terminal 64, the end portion 64*a* of the high voltage terminal 64 is bent so as to shorten the length of the transformer 50. In this case, the cut-out portion 55*d* forming the coil taking-in portion of the secondary coil 62 is disposed so as to be almost perpendicular to a bending direction of the end portion 64*a* of the high voltage terminal 64. Therefore, even though the end portion 64*a* of the high voltage terminal 64 is bent on condition that the secondary coil 62 is twined around the end portion 64*a* of the high voltage terminal 64, an excessive tension added to the secondary coil 62 can be prevented, and an unnecessary loosening of the secondary coil 62 can be prevented.

Figure 13:
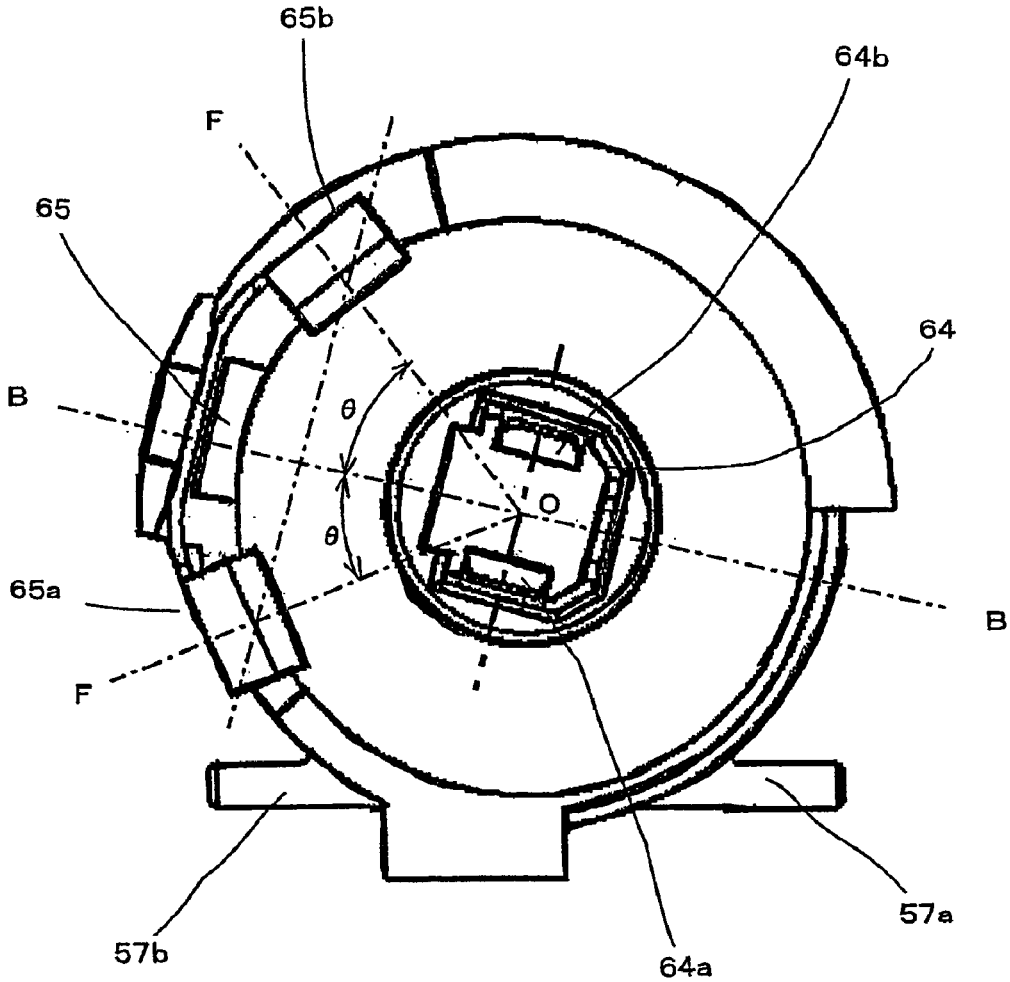
FIG. 13 is a top plan view of the bobbin according to the first embodiment of the present invention.

FIG. 13 is a view explaining a positional relationship between a group of contact elements (or end portions) 64*a* and 64*b* of the high voltage terminal 64 and a group of contact elements 65*a* and 65*b* of the low voltage terminal 65. In FIG. 13, a line B—B denotes a symmetry axis of the contact elements 64*a* and 64*b* of the high voltage terminal 64, and a pair of lines O-F denotes both a line connecting a central point of the contact elements 64*a* and 64*b* of the high voltage terminal 64 and the contact element 65*a* of the low voltage terminal 65 and a line connecting the central point of the high voltage terminal 64 and the contact element 65*b* of the low voltage terminal 65. An angle between the symmetry axis of the contact elements 64*a* and 64*b* of the high voltage terminal 64 and the line O-F extending to the contact element 65*a* of the low voltage terminal 65 is set to θ and is equal to an angle between the symmetry axis of the contact elements 64*a* and 64*b* of the high voltage terminal 64 and the line O-F extending to the contact element 65*b* of the low voltage terminal 65. Therefore, a connection line connecting the contact element 65*a* of the low voltage terminal 65 and the contact element 65*b* of the low voltage terminal 65 is perpendicular to the line B—B. Because the contact elements 64*a* and 64*b* of the high voltage terminal 64 and the contact elements 65*a* and 65*b* of the low voltage terminal 65 are disposed in the above-described positional relationship, a force holding the high intensity discharge bulb 4 is not concentrated in a single direction but is dispersed on the circumference of the bobbin 51. Accordingly, the stability in the holding of the high intensity discharge bulb 4 can be improved.

Embodiment 2

Figure 14:
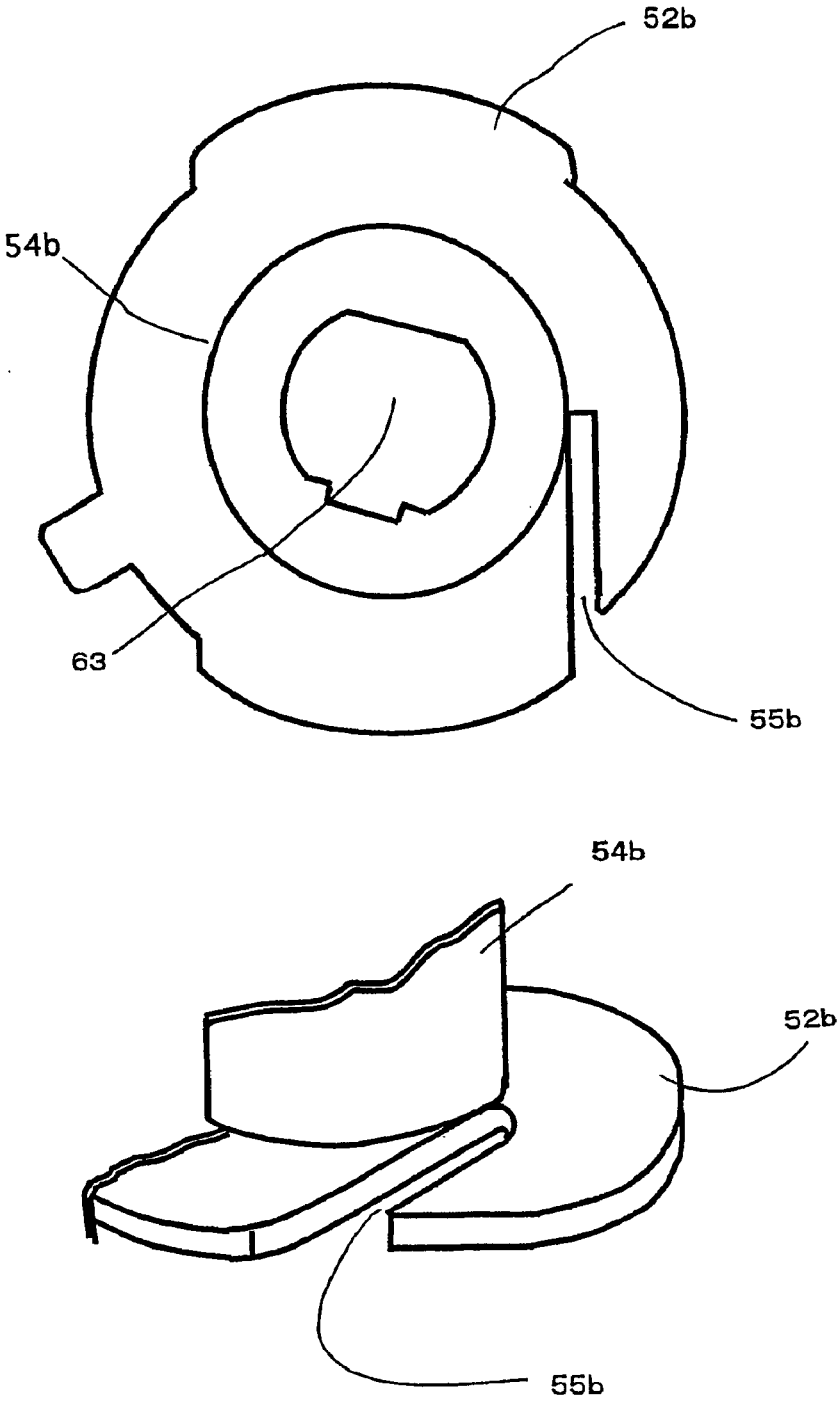
FIG. 14 is a plan view of a partition wall and a diagonal view of the partition wall according to a second embodiment of the present invention.

FIG. 14 is a cross sectional view of a transformer for an igniter according to a second embodiment of the present invention. Different points of the transformer for the igniter from that in the first embodiment are in that each cut-out portion 55 is not formed in the taper shape and no coil escape groove is formed. Therefore, the partition wall 52*b* is cut out so as to extend the cut-out portion 55*b* to the bottom surface 54*b* of the coil winding groove 53*b*.

Accordingly, the delivery of the coil from one coil winding groove to another coil winding groove can be easily performed.

Embodiment 3

Figure 15:
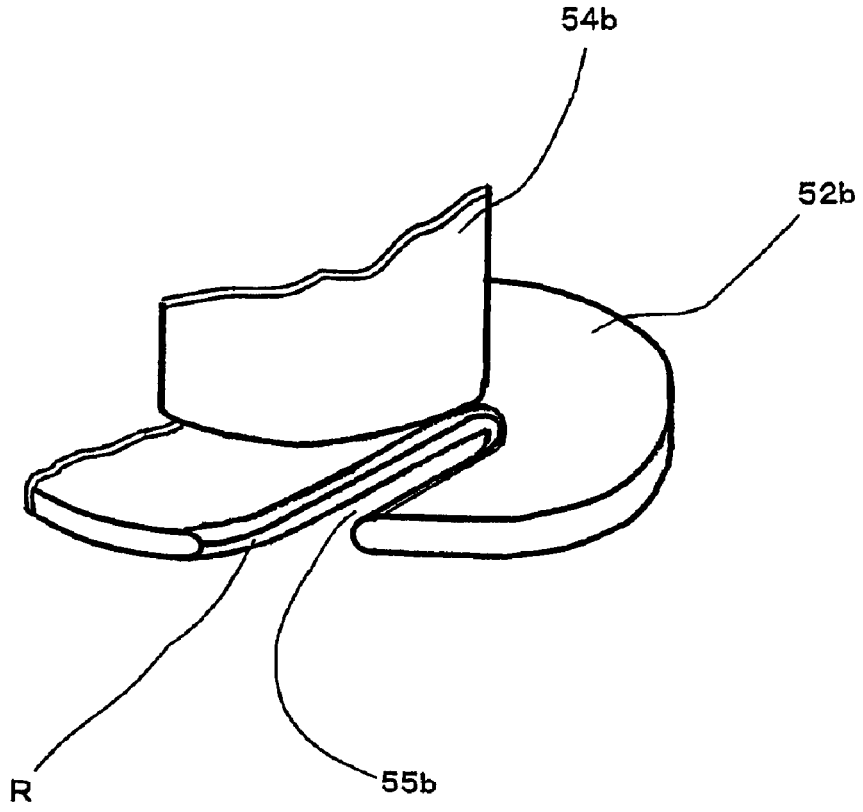
FIG. 15 is a diagonal view of the partition wall according to a third embodiment of the present invention.

FIG. 15 is a cross sectional view of a transformer for an igniter according to a third embodiment of the present invention. An edge area of the cut-out portion 55*b* is formed in a R shape. Therefore, even though the coil is pushed to the cut-out portion 55*b*, a film put on the coil is not damaged. Accordingly, drawbacks due to a rare short can be prevented.

The embodiments are described above, and the embodiments have following characteristics.

One characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the transformer for the igniter in which a secondary coil is wound around a bobbin formed of resin and a primary coil is wound around the bobbin in duplication on the outside of the secondary coil, a plurality of disk-shaped partition walls are disposed on the bobbin, around which the primary coil and the secondary coil are wound, so as to be protruded from the whole circumferential portion of the bobbin in a radial direction of the bobbin, a plurality of coil winding grooves are formed in layers on the disk-shaped partition walls, and a cut-out portion is disposed as a coil taking-in portion or a coil delivery portion of each partition wall. One cut-out portion functions as the coil taking-in portion of the partition wall forming the coil winding groove in which the secondary coil is wound, and the other cut-out portions function as the coil delivery portions of the partition walls so as to successively wind the secondary coil in the coil winding grooves. Therefore, because the cut-out portion functioning as the coil taking-in portion is disposed, the secondary coil can be always taken in the coil winding grooves at a fixed position. Also, because the cut-out portions functioning as the coil delivery portions are disposed, the secondary coil can be always delivered from one coil winding groove to another coil winding groove successively at a fixed position. Accordingly, the damage of the secondary coil due to an acute bending of the secondary coil in each coil delivery portion can be prevented. Also, because the secondary coil is delivered from one coil winding groove to another coil winding groove at a fixed position, the displacement of the secondary coil can be prevented. Therefore, the automatic winding of the secondary coil can be easily performed, and a transformer for an igniter having a high reliability can be obtained.

Also, another characteristic of the embodiments is described as follows.

In the transformer for the igniter in which the cut-out portions functioning as the coil taking-in portion and the coil delivery portions of the partition walls are deeply cut out so as to reach the bottom surfaces of the coil winding grooves of the bobbin respectively, the cut-out portions are deeply cut out so as to reach the bottom surfaces of the coil winding grooves of the bobbin respectively. Because the cut-out portions are deeply cut out so as to reach the bottom surfaces of the coil winding grooves of the bobbin respectively, when the winding of the secondary coil in a next coil winding groove is started after the secondary coil is wound around the bobbin in one coil winding groove, the bending of the secondary coil in the partition walls can be minimized due to the cut-out portions cut out to the bottom surfaces of the coil winding grooves. Also, the winding of the secondary coil can be started from the most-end side of the next coil winding groove. Accordingly, a transformer for an igniter having no displacement of the secondary coil can be easily manufactured on condition that the number of turns of the secondary coil is always stabilized, and a transformer for an igniter having a high reliability can be obtained.

Also, another characteristic of the embodiments is described as follows.

In the transformer for the igniter in which the cut-out portions functioning as the coil taking-in portion and the coil delivery portions of the partition walls are cut out in the almost tangent direction to the coil winding grooves of the bobbin, the cut-out portions are cut out in the almost tangent direction to the coil winding grooves of the bobbin. Because the cut-out portions are cut out in the almost tangent direction to the coil winding grooves of the bobbin, when the winding of the secondary coil in a next coil winding groove is started after the secondary coil is wound around the bobbin in one coil winding groove, the bending of the secondary coil in the partition walls can be further minimized due to the winding start position directed in the almost tangent direction to the coil winding grooves. Also, the winding of the secondary coil can be started from the most-end side of the next coil winding groove. Accordingly, a transformer for an igniter having no displacement of the secondary coil can be easily manufactured on condition that the number of turns of the secondary coil is always stabilized, and a transformer for an igniter having a high reliability can be obtained.

Also, another characteristic of the embodiments is described as follows.

In the transformer for the igniter in which the cut-out portions functioning as the coil taking-in portion and the coil delivery portions of the partition walls are cut out not to reach the bottom surfaces of the coil winding grooves of the bobbin respectively and each coil escape groove becoming hollow on one side surface of the corresponding partition wall in a thickness direction of the corresponding partition wall connects the bottom surface of the corresponding coil winding groove and the corresponding cut-out portion, the coil escape grooves becoming hollow are formed in the thickness directions of the partition walls on the partition walls respectively, and each coil escape groove connects the bottom surface of the corresponding coil winding groove and the corresponding cut-out portion. Because each coil escape groove becoming hollow in the thickness direction of the corresponding partition wall on the partition wall connects the bottom surface of the corresponding coil winding groove and the corresponding cut-out portion, when the winding of the secondary coil in a next coil winding groove is started after the secondary coil is wound around the bobbin in one coil winding groove, the secondary coil of the coil delivery portions is pushed into the coil escape grooves, the secondary coil can be uniformly wound in the whole coil winding grooves without receiving the adverse influence of the secondary coil of the coil delivery portions. Accordingly, a transformer for an igniter having no displacement of the secondary coil can be easily manufactured on condition that the number of turns of the secondary coil is always stabilized, and a transformer for an igniter having a high reliability can be obtained.

Also, another characteristic of the embodiments is described as follows.

In the transformer for the igniter in which each coil escape groove formed on one side surface of the corresponding partition wall is connected to the corresponding cut-out portion on an almost straight line and the direction of the straight line is almost tangent to the bottom surface of the corresponding coil winding groove, each coil escape groove is connected to the corresponding cut-out portion on an almost straight line, and the direction of each straight line is almost tangent to the bottom surface of the corresponding coil winding groove. Because each coil escape groove is connected to the corresponding cut-out portion on an almost straight line so as to direct each straight line in an almost tangent direction to the bottom surface of the corresponding coil winding groove, the secondary coil of the coil delivery portions can be further easily pushed into the coil escape grooves, the secondary coil can be uniformly wound in the whole coil winding grooves without receiving the adverse influence of the secondary coil of the coil delivery portions. Accordingly, a transformer for an igniter having no displacement of the secondary coil can be easily manufactured on condition that the number of turns of the secondary coil is always stabilized, and a transformer for an igniter having a high reliability can be obtained.

Also, another characteristic of the embodiments is described as follows.

In the transformer for the igniter in which the cut-out portions functioning as the coil taking-in portion and the coil delivery portions of the partition walls are respectively formed in a taper shape so as to widen widths of the cut-out portions outward and to gradually narrow the widths of the cut-out portions inward, the cut-out portions are respectively formed in a taper shape so as to widen the widths of the cut-out portions outward and to gradually narrow the widths of the cut-out portions inward. Because the cut-out portions are respectively formed in a taper shape so as to widen the widths of the cut-out portions outward, the secondary coil can be reliably lead to the cut-out portions, and the stable delivery of the secondary coil can be always performed.

Also, another characteristic of the embodiments is described as follows.

In the transformer for the igniter in which one coil taking-in portion is formed by cutting out the corresponding partition wall to take a winding start end of the secondary coil connected to a high voltage terminal in one coil winding groove and a rib-shaped edge portion projected in an axial direction of the partition walls is formed on either the whole circumferential edge of the coil taking-in portion or at least a part of the circumferential edge of the coil taking-in portion making contact with the secondary coil, the rib-shaped edge portion projected in the axial direction of the partition walls is formed on either the whole circumferential edge of the cut-out portion cut out in the coil taking-in portion or at least a part of the circumferential edge of the cut-out portion making contact with the secondary coil. Because the rib-shaped edge portion is formed on the cut-out portion of the coil taking-in portion, the strength of the edge portion of the cut-out portion in the taking of the secondary coil in the coil winding groove can be heightened, it can be prevented that the cut-out portion is damaged due to a tensile force of the secondary coil.

Also, another characteristic of the embodiments is described as follows.

In the transformer for the igniter in which the whole circumferential edge portion of each cut-out portion functioning as the coil taking-in portion or the coil delivery portion of the corresponding partition wall or at least a corner portion of the edge portion of the cut-out portion making contact with the secondary coil is formed in a curved shape or is chamfered, the whole circumferential edge portion of the cut-out portion or at least a corner portion of the edge portion of the cut-out portion making contact with the secondary coil is formed in a curved shape or is chamfered. Because the corner portion making contact with the secondary coil is formed in a curved shape or is chamfered, there is no probability that a film coated on the secondary coil making contact with the corner portion is damaged. Accordingly, drawbacks such as a rare short due to the destruction of the film of the secondary coil can be prevented.

Also, another characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the transformer for the igniter in which a secondary coil is wound around a bobbin formed of resin and a primary coil is wound around the bobbin in duplication on the outside of the secondary coil and a plurality of resin leading grooves are formed on side surfaces of a plurality of partition walls, on which a plurality of coil winding grooves corresponding to the secondary coil ranging from a low voltage step to a high voltage step are formed respectively in layers, to harden a lamination layer portion of the primary and secondary coils with resin after the winding of the primary and secondary coils, the resin leading grooves are formed on the side surfaces of the partition walls, on which the coil winding grooves are formed respectively, to harden the lamination layer portion of the primary and secondary coils with resin after the winding of the primary and secondary coils. Because the resin leading grooves are formed on the side surfaces of the partition walls respectively, even though the density of the coils is high, there is no probability that the resin leading grooves are covered with the primary and secondary coils. Accordingly, the resin injected from the resin leading grooves can easily permeate the inside of the lamination layer portion of the primary and secondary coils, and the reliability of the lamination layer portion of the primary and secondary coils can be considerably improved.

Also, another characteristic of the embodiments is described as follows.

In the transformer for the igniter in which the resin leading grooves reach the bottom surfaces of the coil winding grooves and an extension line of the resin leading grooves does not intersect an axial line of the bobbin, the resin leading grooves reach the bottom surfaces of the coil winding grooves and the extension line of the resin leading grooves does not intersect the axial line of the bobbin. Therefore, the extension line of the resin leading grooves can directed in a direction tangent to the bottom surfaces of the coil winding grooves. Because the resin leading grooves are extended in the tangent direction to the bottom surfaces of the coil winding grooves, each resin leading groove can be lengthened. Accordingly, because the resin can further uniformly permeate the lamination layer portion of the primary and secondary coils, the reliability of the lamination layer portion of the primary and secondary coils can be considerably improved.

Also, another characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the transformer for the igniter, a primary coil and a secondary coil are wound around a bobbin formed of resin, the bobbin is inserted into a bulb socket and is fixed, and resin is injected into a peripheral space of the bobbin. Also, in the transformer for the igniter, a plurality of coil winding grooves corresponding to the secondary coil ranging from a low voltage step to a high voltage step are formed on a plurality of partition walls respectively in layers, and a most-outer circumferential diameter of parts of the partition walls differs from that of the other parts of the partition walls. Even though the most-outer circumferential diameter of parts of the partition walls, on which the coil winding grooves are formed respectively in layers, differs from that of the other parts of the partition walls and the bobbin is disposed in a bobbin case of which an inner diameter is almost equal to the larger most-outer circumferential diameter of the partition walls, though portions of the partition walls corresponding to the larger most-outer circumferential diameter of the partition walls make contact with an inner wall of the bobbin case, a prescribed space is formed between the other portions of the partition walls corresponding to the smaller most-outer circumferential diameter of the partition walls and the inner wall of the bobbin case. Therefore, because the portions of the partition walls corresponding to the larger most-outer circumferential diameter of the partition walls make contact with the bobbin case, the displacement of the bobbin in the radial direction of the bobbin can be suppressed. Also, the resin is packed in the outer circumferential space of the bobbin to improve the electric insulation, the water proof and the vibration proof of the bobbin inserted in the bobbin case and fixed. In this case, because the smaller most-outer circumferential diameter of the other portions of the partition walls is smaller than the larger most-outer circumferential diameter of the portions of the partition walls, a space between the group of the partition walls and the bobbin case functions as a resin leading path, and the whole outer circumferential portion of the bobbin can be uniformly protected.

Also, another characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the transformer for the igniter, a secondary coil is wound around a bobbin formed of resin and a primary coil is wound around the bobbin in duplication on the outside of the secondary coil, a pair of twining protrusive portions are protruded from either a most-outer circumferential wall of a low voltage side end portion of the bobbin or an arbitrary point near to the most-outer circumferential wall of the low voltage side end portion of the bobbin in both tangent directions to the most-outer circumferential wall of the low voltage side end portion of the bobbin respectively to twine a winding finish end of the secondary coil wound in the coil winding grooves of the plurality of layers and both a winding start end and a winding finish end of the primary coil wound on the outer circumference of the secondary coil around the twining protrusive portions, and a total length from one end to the other end of the group of the twining protrusive portions is set to be equal to or lower than the diameter of the most-outer circumferential wall of the low voltage side end portion. In this case, the twining protrusive portions are protruded from the most-outer circumferential wall of the low voltage side end portion of the bobbin or an arbitrary point near to the most-outer circumferential wall of the low voltage side end portion of the bobbin to the tangent directions to the most-outer circumferential wall of the low voltage side end portion of the bobbin respectively to twine both the winding start end and the winding finish end of the primary coil around the twining protrusive portions, and a total length from one end to the other end of the group of the twining protrusive portions is set to be equal to or lower than the diameter of the most-outer circumferential wall of the low voltage side end portion. Therefore, the twining portions of the primary coil are protruded from a position near to the most-outer circumferential wall of the low voltage side end portion of the bobbin in both tangent directions to the outer circumference portion of the bobbin respectively, and a total length of the twining portions is set to be equal to or lower than the diameter of the most-outer circumferential wall of the low voltage side end portion of the bobbin. Accordingly, the length of the coil twining portions can be lengthened at its maximum without enlarging the bobbin case. Also, a small-sized device and a coil twining operation with facility can be obtained.

Also, another characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the transformer for the igniter, a secondary coil is wound around a bobbin formed of resin and a primary coil is wound around the bobbin in duplication on the outside of the secondary coil, and each of a pair of positioning protrusive portions is disposed on at least one partition wall of both partition walls surrounding one coil winding groove, in which either a winding start end or a winding finish end of the primary coil is placed, to twine both the winding start end and the winding finish end of the primary coil around the positioning protrusive portions respectively. In this case, each positioning protrusive portion is disposed on at least one partition wall of both partition walls surrounding one coil winding groove, in which either the winding start end or the winding finish end of the primary coil is placed, to twine both the winding start end and the winding finish end of the primary coil around the positioning protrusive portions respectively. Because each positioning protrusive portion is disposed on at least one partition wall of both partition walls surrounding one coil winding groove in which either the winding start end or the winding finish end of the primary coil wound on the outside of the secondary coil is placed, the disorder of the primary coil wound can be prevented, and the winding positions of both the winding start end and the winding finish end of the primary coil can be reliably fixed. Accordingly, the automatic manufacturing can be easily performed so as to stably perform the winding operation of the primary coil wound on the outside of the secondary coil.

Also, another characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the transformer for the igniter in which a high voltage terminal penetrating through a central area of a bobbin and a secondary coil is wound around the bobbin which has a plurality of coil winding grooves formed in layers, a secondary coil taking-in slit is disposed in a direction perpendicular to a bending direction of a top end of a high voltage terminal around which the secondary coil is twined, and a positional relationship between the secondary coil taking-in slit and the top end of the high voltage terminal is set not to excessively loosen or tighten the winding start end of the secondary coil on condition that the top end of the high voltage terminal is bent after the winding of the secondary coil. In this case, the secondary coil taking-in slit is disposed in a direction perpendicular to a bending direction of the top end of the high voltage terminal. Because the secondary coil taking-in slit, through which the secondary coil is taken in one coil winding groove of the bobbin, is disposed in a direction perpendicular to a bending direction of the top end of the high voltage terminal around which the secondary coil is twined, the excessive loosening or tightening of the winding start end of the secondary coil between the secondary coil twining portion (or the top end of the high voltage terminal) and the secondary coil taking-in slit can be suppressed when the top end of the high voltage terminal is bent on condition that the secondary coil is wound around the top end of the high voltage terminal. Accordingly, drawbacks such as the loss and loosening of the secondary coil due to the bending of the secondary coil at the high voltage terminal can be prevented, and a small-sized transformer can be obtained in the automatic winding operation with high reliability.

Also, another characteristic of the embodiments is described as follows.

A transformer for an igniter is used for a control device of a head lamp of a vehicle, the control device comprises a high intensity discharge bulb (or a discharge bulb) disposed in a head lamp of an automobile, a ballast (or a driving power supply circuit) for supplying an alternating current power from a battery power source to the high intensity discharge bulb, and an igniter (or a start circuit) for generating a high voltage pulse to start the discharge of the high intensity discharge bulb. In the control device of the head lamp of the vehicle in which a plurality of contact elements of a high voltage terminal divided each other and a plurality of contact elements of a low voltage terminal divided each other are disposed in the high intensity discharge bulb and the high intensity discharge bulb is held by a bulb socket, one pair of contact elements of the high voltage terminal, which is disposed to place a high voltage plug of the high intensity discharge bulb between the pair of contact elements of the high voltage terminal, and one pair of contact elements of the low voltage terminal apart from each other in a circumferential direction of the bobbin so as to make contact with a low voltage plug of the high intensity discharge bulb are disposed in the transformer for the igniter so as to make an extension line of a symmetric axis of the pair of contact elements of the high voltage terminal almost intersect a connection line connecting the pair of contact elements of the low voltage terminal at right angles at an almost central point of the connection line. Because the pair of contact elements of the high voltage terminal and the pair of contact elements of the low voltage terminal, which are apart from each other in a circumferential direction of the bobbin so as to make contact with the low voltage plug of the high intensity discharge bulb, are disposed so as to make an extension line of a symmetric axis of the pair of contact elements of the high voltage terminal almost intersect a connection line connecting the pair of contact elements of the low voltage terminal at right angles at an almost central point of the connection line, the pair of contact elements of the low voltage terminal can be disposed on both sides of the symmetry line at almost 45 degrees respectively with respect to the symmetry line. Also, the pair of contact elements of the high voltage terminal and the pair of contact elements of the low voltage terminal are disposed so as to make the connection line connecting the pair of contact elements of the low voltage terminal be perpendicular to the extension line of a symmetric axis of the pair of contact elements of the high voltage terminal, and the pair of contact elements of the low voltage terminal are disposed on both sides of the symmetry line at almost 45 degrees respectively with respect to the symmetry line. Accordingly, in cases where the plugs of the high intensity discharge bulb are held by all the contact elements of the high and low voltage terminals, the holding force of the contact elements of the high voltage terminal and the holding force of the contact elements of the low voltage terminal are not shifted in the same direction as each other or the perpendicular direction to each other, and the high intensity discharge bulb can be further stably held.

INDUSTRIAL APPLICABILITY

As is described above, the transformer for the igniter according to the present invention is appropriate for a transformer for an igniter, in which a high voltage pulse is generated, and a transformer for an igniter used for an electric-discharge lamp used as a head lamp of a vehicle such as an automobile.

What is claimed is:

1. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers; and a plurality of cut-out portions functioning as a coil taking-in portion and a plurality of coil delivery portions of the disk-shaped partition walls;

wherein the cut-out portions functioning as the coil taking-in portion and the coil delivery portions of the disk-shaped partition walls are obtained by cutting out the disk-shaped partition walls in an almost tangent direction to the bottom surfaces of the coil winding grooves of the bobbin.

2. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers; and a plurality of cut-out portions functioning as a coil taking-in portion and a plurality of coil delivery portions of the disk-shaped partition walls;

wherein each of the cut-out portions functioning as the coil taking-in portion and the coil delivery portions of the disk-shaped partition walls does not reach the bottom surface of the corresponding coil winding groove of the bobbin, and each cut-out portion and the bottom surface of the corresponding coil winding groove are connected with each other by a coil escape groove becoming hollow on one side surface of the corresponding partition wall in a thickness direction of the corresponding partition wall.

3. A transformer for an igniter according to claim 2, wherein each cut-out portion and the corresponding coil escape groove disposed on one side surface of the corresponding partition wall are connected with each other on an almost straight line, and the straight line is directed in an almost tangent direction to the bottom surface of the corresponding coil winding groove of the bobbin.

4. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers; and a plurality of cut-out portions functioning as a coil taking-in portion and a plurality of coil delivery portions of the disk-shaped partition walls;

wherein the coil taking-in portion is formed by cutting out the corresponding partition wall to take a winding start end of the secondary coil connected to a high voltage terminal in the corresponding coil winding groove, and a rib-shaped edge portion projected in an axial direction of the corresponding partition wall is disposed on either a whole circumferential edge of the coil taking-in portion or at least a part of the circumferential edge of the coil taking-in portion making contact with the secondary coil.

5. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers; and a plurality of cut-out portions functioning as a coil taking-in portion and a plurality of coil delivery portions of the disk-shaped partition walls;

wherein whole circumferential edge portions of the cut-out portions functioning as the coil taking-in portion and the coil delivery portions of the disk-shaped partition walls or at least corner portions of circumferential edge portions of the cut-out portions making contact with the secondary coil are respectively formed in a curved shape or are respectively chamfered.

6. A transformer for an igniter in which a primary coil and a secondary coil are wound around a bobbin, comprising:

a plurality of partition walls disposed on the bobbin so as to form a plurality of coil winding grooves corresponding to the secondary coil ranging from a low voltage step to a high voltage step in layers; and a plurality of resin leading grooves disposed on a plurality of side surfaces of the partition walls to input resin, thereby disposing a lamination layer on the primary and secondary coils, after the winding of the primary and secondary coils;

wherein the resin leading grooves reach bottom surfaces of the coil winding grooves, and a line directed in an extension direction of each resin leading groove does not intersect an axial line of the bobbin.

7. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers; and a plurality of cut-out portions functioning as a coil taking-in portion and a plurality of coil delivery portions of the disk-shaped partition walls;

wherein resin is injected into a peripheral space of the bobbin, the partition walls are disposed on the bobbin so as to form the coil winding grooves corresponding to the secondary coil ranging from a low voltage step to a high voltage step in layers, and a diameter of a most-outer circumference of a part of each partition wall is changed in a circumferential direction of the partition wall.

8. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers;

a plurality of cut-out portions functioning as a coil taking-in portion and a plurality of coil delivery portions of the disk-shaped partition walls; and a pair of twining protrusive portions, which are protruded from either a most-outer circumferential wall of a low voltage side end portion of the bobbin or an arbitrary point near to the most-outer circumferential wall of the low voltage side end portion of the bobbin in both tangent directions to the most-outer circumferential wall of the low voltage side end portion of the bobbin respectively to twine a winding finish end of the secondary coil, which is wound in the layers of coil winding grooves, and both a winding start end and a winding finish end of the primary coil, which is wound around an outer circumferential portion of the secondary coil, around the twining protrusive portions, wherein a total length of the twining protrusive portions is set to be equal to or lower than the diameter of the most-outer circumferential wall of the low voltage side end portion.

9. A transformer for an igniter according to claim 7, further comprising:

a pair of positioning protrusive portions, each of which is disposed on at least one of the partition walls surrounding the corresponding coil winding groove, in which either a winding start end or a winding finish end of the primary coil is placed, to twine both the winding start end and the winding finish end of the primary coil around the positioning protrusive portions.

10. A transformer for an igniter in which a primary coil and a secondary coil are wound around a bobbin, comprising:

a plurality of disk-shaped partition walls disposed on the bobbin, around which the primary coil and the secondary coil are wound, so as to protrude from all circumferential surface of the bobbin in a radial direction of the bobbin and to form a plurality of coil winding grooves in layers;

a plurality of cut-out portions functioning as a coil taking-in portion and a plurality of coil delivery portions of the disk-shaped partition walls; and a secondary coil taking-in slit which is disposed in a direction perpendicular to a bending direction of a top end of a high voltage terminal around which the secondary coil is twined, wherein the transformer is used for a vehicle head lamp control device comprising a high intensity discharge bulb disposed in a head lamp of an automobile, a ballast for supplying an alternating current power from a battery power source to the high intensity discharge bulb, an igniter for generating a high voltage pulse to start the discharge of the high intensity discharge bulb and the high voltage terminal for supplying a high voltage to the high intensity discharge bulb, and the high voltage terminal penetrates through a central area of the bobbin.

* * * * *